US012752896B2

(12) United States Patent
Caswell

(10) Patent No.: US 12,752,896 B2
(45) Date of Patent: Oct. 6, 2026

(54) CHASSIS FOR LONG TAIL MARINE OUTBOARD ENGINE

(71) Applicant: Michael Caswell, Fairport, NY (US)

(72) Inventor: Michael Caswell, Fairport, NY (US)

( * ) Notice: Subject to any disclaimer, the term of this patent is extended or adjusted under 35 U.S.C. 154(b) by 313 days.

(21) Appl. No.: 18/468,397

(22) Filed: Sep. 15, 2023

(65) Prior Publication Data

US 2025/0091702 A1 Mar. 20, 2025

(51) Int. Cl.
*B63H 20/06* (2006.01)
*B63H 20/02* (2006.01)
*B63H 20/08* (2006.01)

(52) U.S. Cl.
CPC ..... *B63H 20/06* (2013.01); *B63H 20/08* (2013.01); *B63H 2020/025* (2013.01)

(58) Field of Classification Search
CPC ..... B60H 20/06; B60H 20/08
See application file for complete search history.

(56) References Cited

U.S. PATENT DOCUMENTS 5,741,165 A * 4/1998 Saito ..... F02B 75/16 248/641
7,297,035 B2 * 11/2007 Broussard ..... B63H 20/32 440/75
8,911,272 B1 * 12/2014 Gilk ..... B63H 5/14 440/66
2001/0041482 A1 * 11/2001 Foreman ..... B63H 23/321 440/53
2012/0214366 A1 * 8/2012 Uhlenhopp ..... B63H 20/20 440/83

* cited by examiner

*Primary Examiner* — Aaron L Troost

(57) ABSTRACT

A chassis for mounting an engine and a low draft drive shaft and propellor adjustable to optimize the effective propellor vector parallel to the water's surface. The chassis is strong, lightweight and capable of mounting simple air-cooled engines with or without clutch mechanisms.

1 Claim, 8 Drawing Sheets

CHASSIS FOR LONG TAIL MARINE OUTBOARD ENGINE

BACKGROUND OF THE INVENTION

The present invention relates to a marine engine mounting system providing an improved long tail marine motor system. Long tail drives originated in South East Asia where relatively shallow water routes require the ability to have low depth propulsion. Historically, these systems employ long drive shafts connected to salvaged engines. The long drive shaft connected directly to an engine can be raised and lowered behind a boat. The long tail motors have been, for the most part, rudimentary and used with long boats both small and large.

Traditional long tail boats use straight drive shafts. The simplicity of straight drive shafts is their simplicity, but the propellor vector is not optimal for propulsion. The response of making longer drive shafts is some answer to this disadvantage, but also has the disadvantage of increasing the offset of the axis of propulsion away from the centerline of the boat hull.

SUMMARY

The present invention uses an s shaped tube with a flexible internal drive shaft allowing for a shorter drive mechanism with a propeller offset that parallels the water surface more closely in operation. The drive shaft is attached to the engine holder via a mounting stem formed from the two ends of a tube portion welded together. The drive shaft mounts on top of the two parallel tubes of the mounting stem with at least two brackets.

The inner portion of the tube alternately can be formed in some other form other than a rounded off rectangle. The engine mounting portion also has a swivelable mount on the aft portion that is insertable into a transom mount. A positioner stem is provided at the aft end of the engine mount box to hold the engine and longtail in position. At the fore portion of the engine mount box is a handle holder swivelably connectable to a handle with three sections that allows rotation of the handle so that it ranges from left to right so the long tail engine can be turned off center.

The present invention provides a chassis for mounting an engine and a low draft drive shaft and propellor adjustable to optimize the effective propellor vector parallel to the water's surface. The chassis is strong, lightweight and capable of mounting simple air-cooled engines with or without clutch mechanisms. Typically clutches have not been used in long tail marine systems. However, the present system provides a chassis that allows a clutch between the engine and the driveshaft by having at least two mounting configurations. This allows a space for use of the clutch between the engine and the driveshaft, or alternately a direct connection.

DETAILED DESCRIPTION OF THE INVENTION

Figure 1:
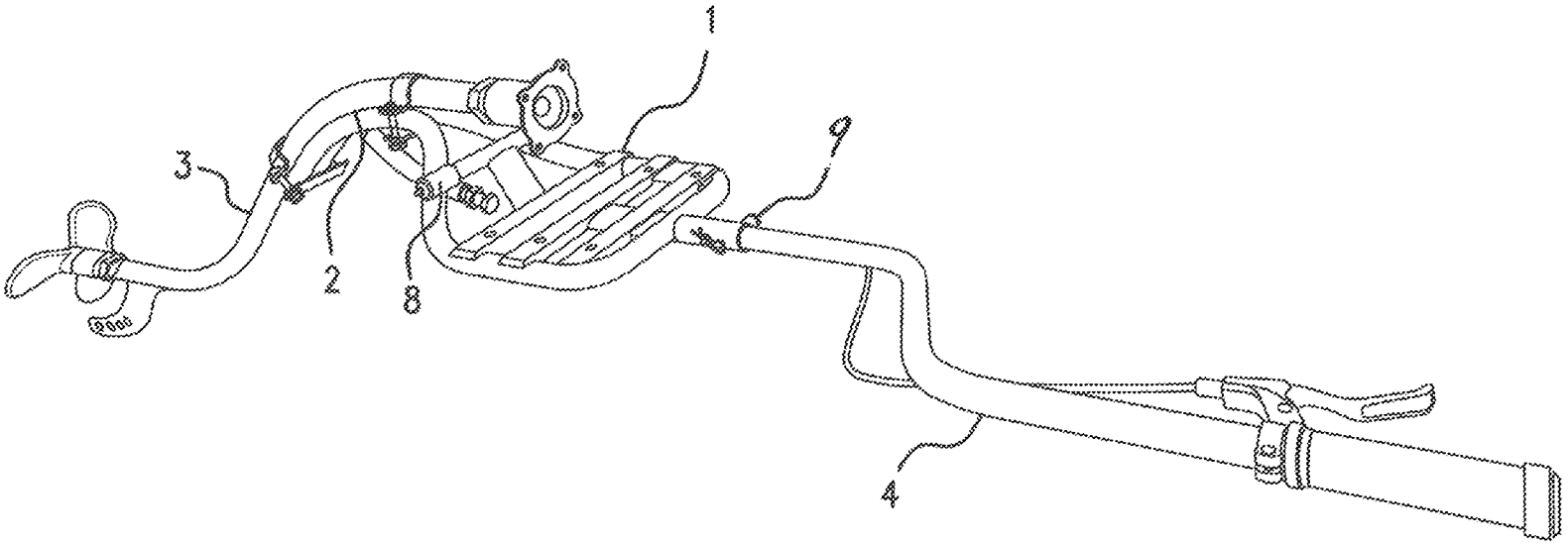
FIG. 1 shows a three quarters view of the chassis from the fore view.

FIG. 1 shows a three quarters view of the marine engine chassis. The assembled chassis has a central engine mounting segment 1 with a drive shaft mounting stem 2 extending aftward and a pivot extension also aftward 8 that is attachable to a transom mount 7 with a pivot base. The central engine mounting system also has a handle pivot 9 on the fore portion of the engine mounting segment.

Figure 2:
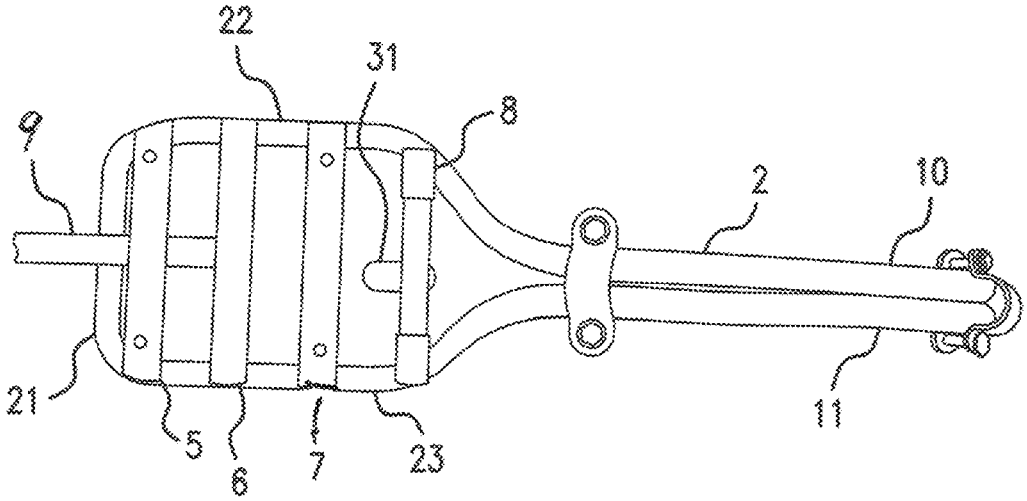
FIG. 2 shows a top view of the Engine box section and mounting stem.

The engine mounting segment and trailing drive shaft mounting segment is shown in FIG. 2 where the engine mounting segment 1 is formed by a bent tube section that forms the front segment 21 of the chassis and the left side 22 and right side 23 that trails back to the drive shaft mounting stem 2. The chassis has three cross bars 5, 6, 7 extending from the left side 12 to the right side 13 with two holes or threaded fastener sections. The three cross bars are spaced to match the spacing of engine mounting bolts. Typically, there are parallel mounts on an engine spaced at standard spacings.

FIG. 2 illustrates how the three engine mounting cross members allow an engine to be mounted with or without a clutch. The difference in spacing allows for a clutch unit by either placing the engine on the first two cross members nearest the front. An engine without a clutch or on the second and third mounting cross members since the overall unit is shorter without a clutch. The three cross bars also provide greater strength and stiffness for the chassis in general across the engine mounting segments and the drive shaft mount segment.

Behind the three cross members is a fourth cross-member 8 which is a swivel cross member between the two rails and a downward extension that attaches to a horizontal swivel joint 31 on a transom mount 30 with a pivot extending downward that cooperates with a transom pivot. One form of the transom is a channel box with bolts for fastening to a transom of a boat.

There is an adjustable engine rest 9 connected to the stem portion running downward and forwards from the extension stem as shown in FIG. 2. The engine rest is adjustable with a threaded bump extension 9*a* at the forward end which can be adjusted to extend or contract. The purpose of the adjustable engine rest is to allow tuning of the track of the propellor at the end of the S shaped drive shaft 3. Because of the S shaped drive shaft, the effective angle can be optimized by changing the effective length of the threaded bump extension.

The transom mounting stem bends downward from the plane of the engine mount stem holding the engine. This engine holding section 2 is formed by the tube portion in the middle of the stem portion formed by the ends of the tube 10, 11. The front tube portion 21 forms a rounded rectangle with three braces going from the left side 23 and right side 24 side portions of the rounded rectangle. The three cross braces have engine mounting holes and can have additional mounting hardware such as hardened elastic mounts.

Figure 4:
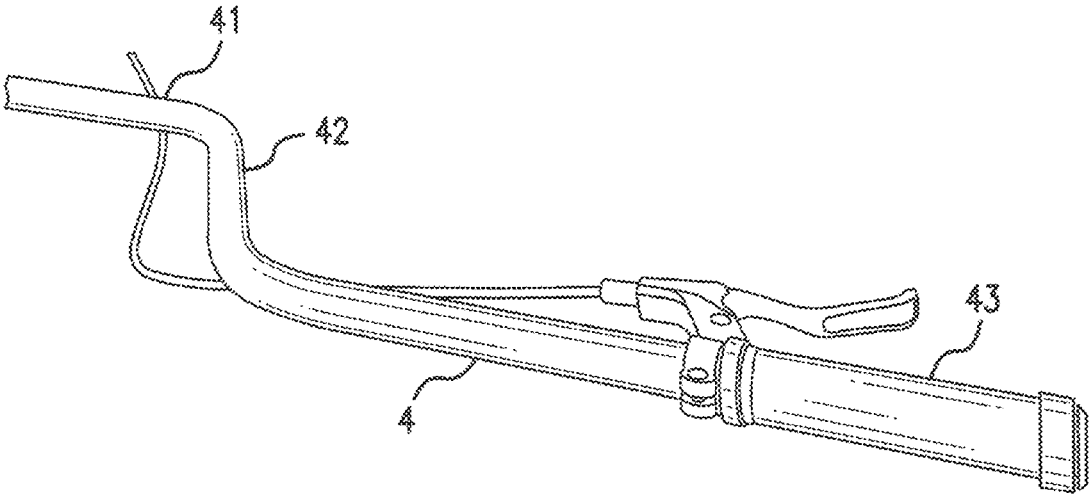
FIG. 4 shows the handle.

The front side of engine mounting segment 21 is formed from the connecting tube portion which has a central handle connector joint 9 which accepts the handle. The central connector handle accepts in a swiveble fashion, the handle 4. The swiveble handle allows handle position to be more customizable. The central connector for the handle spans the tube and at least at least one of the three cross rails for engine mounting. The handle show in FIG. 4 can be made from a single piece of tubing or subsections but has in complete form three segments: a swivel mounting segment, 41, an offset segment 42 connecting to the swivel segment which extends off the axis of the swivel mounting segment, and a third handle 43 segment that runs parallel to the swivel mounting segment.

Figure 5:
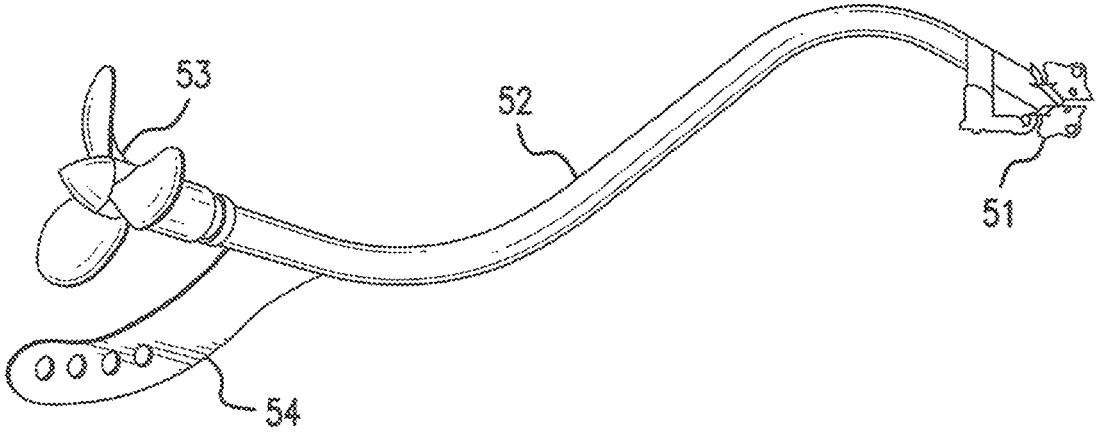
FIG. 5 shows the Drive shaft assembly in an S shaped configuration.

The S shaped drive shaft 3 shown in FIGS. 1 and 5 has a mounting hub 51 attached to a flexible drive shaft contained within an s-shaped housing 52 with at least two bearings to guide the drive shaft, a propellor 53 and a mud guard 54. This S shaped drive shaft configuration allows the engine mount segment and the rest bump 9 to be used to tune the effective propulsion vector of the propellor.

The single tube construction of the engine mounting segment and the stem portion provides a unique construction with greater strength and less weight. The three engine mounting cross bars allow provision for clutchless and clutch engine configurations. Provision of the engine rest allows easy tuning of propellor vector parallel to the surface of the water.

Figure 6:
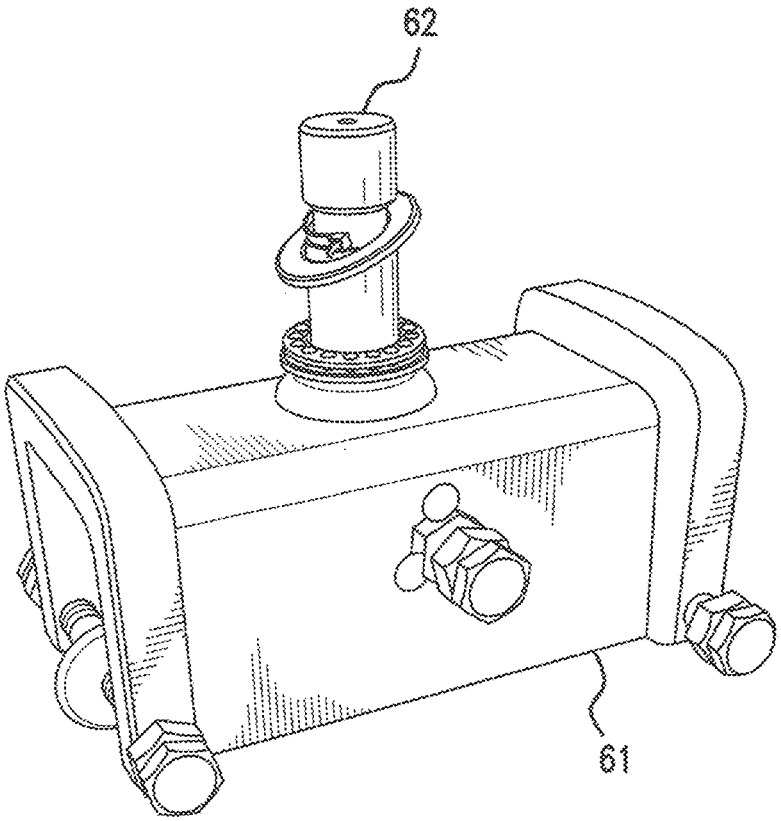
FIG. 6 shows the transom mount.

The transom mount shown in FIG. 6 provides an effective, secure and adjustable means for securing the chassis to a boat transom. The mount 31, has a rotatable stem 32 attaching the swivelable socket of the fourth crossmember of the engine mounting segment. The stem is attached to the top of a channel box which can be fitted over a boat transom and secured with three bolts and two tighteners. The three bolts are comprised of two parallel bolts and a center higher bolt. This transom mount allows the chassis to be affixed to a light weight boat FIG. 2 shows an upper view of the engine mounting box of the chassis along with the right segment of the single continuous tube, the left segment, the front segment, the center mounted handle coupling connecting the front segment and at least one cross rail. The three cross rails connect the left segment and the right segment. Also shown is the superior view of the fourth swivelable hinge cross member 8 with the fixture to attach to a transom mounting box. The hinge cross member has a coupling extending downwards that allows the member to raise and lower the drive shaft and or swing it left and right. The handle operates against the fourth cross-member to lower and raise the drive shaft or steer it left or right.

Figure 3:
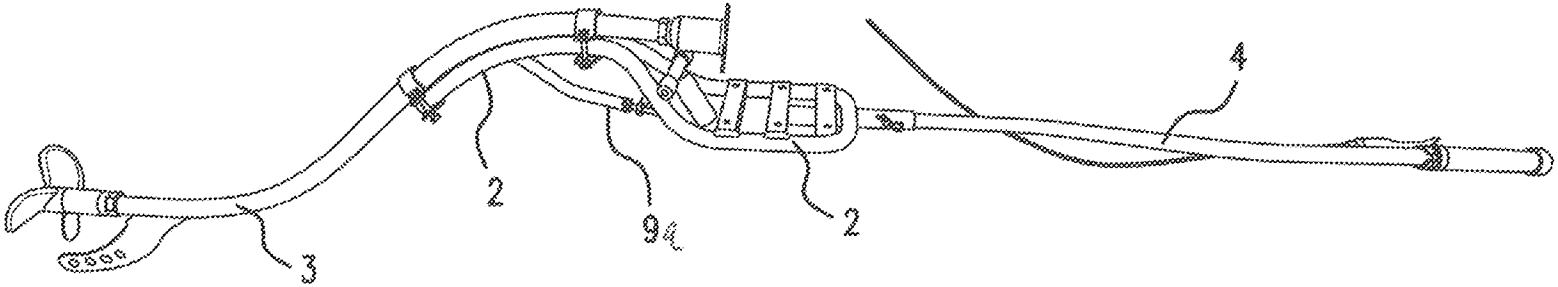
FIG. 3 shows a Side view of the Assembled Chassis

FIG. 3 shows a side view of the chassis with the S shaped drive train and handle attached. From this view it is clear the engine mounting box is in a plane and the tubes forming the drive shaft mounting stem rise from that plane and above the level of the power output of the engine to be attached and then curve downwards. The segment curving downwards is formed from the two ends of the tube joined in a curve matching the forward section of the S-shaped drive shaft. FIG. 5 shows the S-shaped drive shaft assembly with mounting to the engine output a first segment that is mountable to the chassis stem a center portion that is intended to enter the water and a thirds portion curved upward so the propellor's force vector is parallel to the surface of the water. The S-shaped drive shaft segment also has a mounting fixture that attaches to an engine power output. The S-shaped drive also has a propellor attached at the far end and a mud guard mounted fore of the propellor on the bottom end of the shaft.

Also shown in FIG. 3 is the swivelable cross member 8. The engine rest stem 9 that projects forward from the engine mounting stem and allows a resting point against the transom is shown. The adjustable stem has a threaded extender 9*a* that can be arranged anywhere on its body to provide a variable length to the stem.

FIG. 6 shows a transom mount 61 formed which the chassis' swivelable cross section mounts. The stem 62 from the transom mounts accepts the tube from the swivelable cross member.

Figure 7:
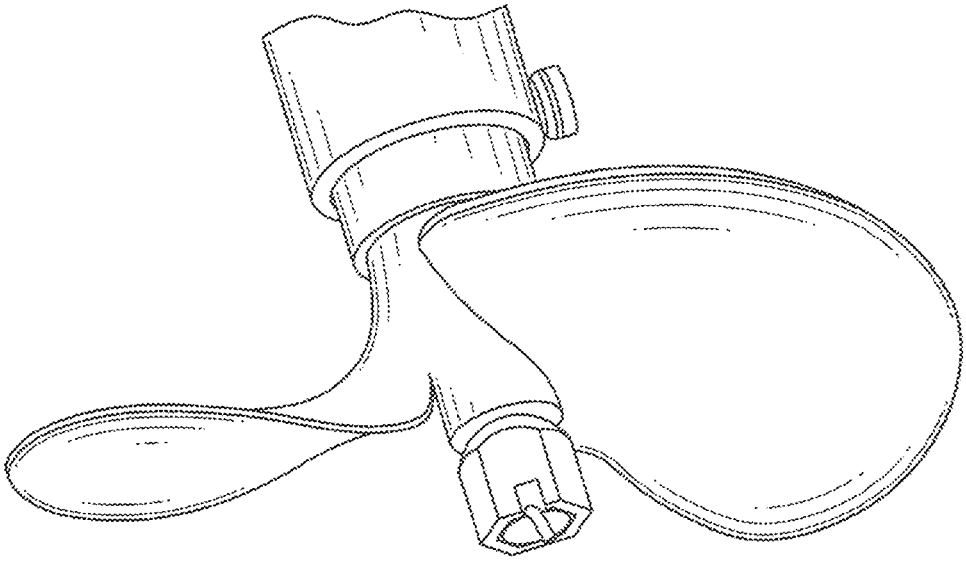
FIG. 7 shows a preferred propellor.

FIG. 7 shows a preferred two blade propellor.

Figure 8:
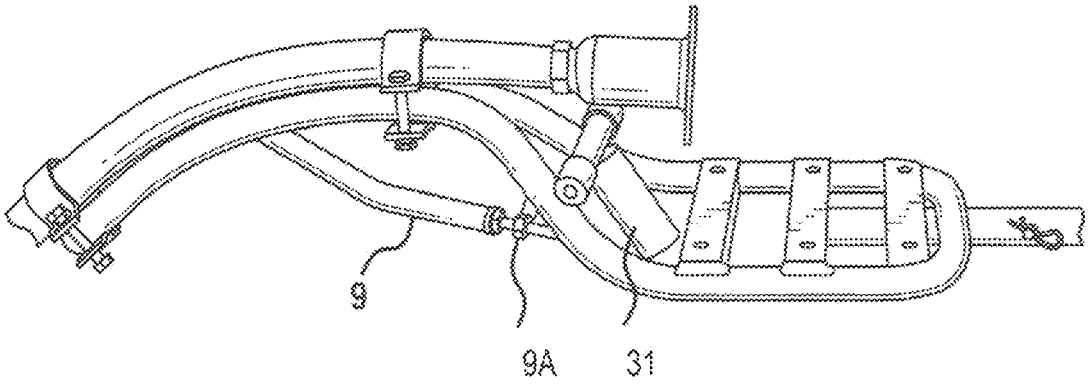
FIG. 8 shows a side view of the chassis.

FIG. 8 shows a view of the chassis and illustrates a general form of the engine mounting box. The three cross members each have two mounting holes or fixtures allowing an engine to be mounted at four points. This view shows the engine rest 9, the adjustable screw extender 9*a* and the swivelable engine stem 8*a*.

What is claimed is:

1. A marine engine chassis providing a low draft long tail propulsion system comprising: an engine mounting bracket made from a bent single tube with an engine mounting segment and a mounting stem for connecting a drive shaft formed from the ends of the tube welded together; an S-shaped drive shaft mountable to said mounting stem wherein the engine mounting bracket has three engine mounting cross-braces and a pivot swivel cross braces and a handle mounted fixture.

* * * * *